US006647227B2

(12) United States Patent
Yokoi et al.

(10) Patent No.: US 6,647,227 B2
(45) Date of Patent: Nov. 11, 2003

(54) INTERMEDIATE TRANSFER TYPE IMAGE FORMING APPARATUS AND METHOD THEREOF

(75) Inventors: Katsuyuki Yokoi, Iwakura (JP); Atsushi Kato, Haguri-gun (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 10/252,362

(22) Filed: Sep. 24, 2002

(65) Prior Publication Data

US 2003/0059230 A1 Mar. 27, 2003

(30) Foreign Application Priority Data

Sep. 27, 2001 (JP) ..... P2001-298628

(51) Int. Cl.[7] ..... G03G 21/16; G03G 21/18

(52) U.S. Cl. ..... 399/111; 399/112; 399/113; 399/121

(58) Field of Search ..... 399/110, 111, 399/112, 113, 116, 121; 347/152

(56) References Cited

U.S. PATENT DOCUMENTS

| | | | | |
|---|---|---|---|---|
| 6,453,135 | B1 * | 9/2002 | Sameshima et al. | 399/110 |
| 6,522,861 | B2 * | 2/2003 | Tokutake et al. | 399/299 |
| 6,549,731 | B1 * | 4/2003 | Yoshida et al. | 399/119 |

FOREIGN PATENT DOCUMENTS

| | | | |
|---|---|---|---|
| JP | U 3-110445 | | 11/1991 |
| JP | A 4-40478 | | 2/1992 |
| JP | A 8-254936 | | 10/1996 |
| JP | 11-109811 | A * | 4/1999 |
| JP | 11-288206 | A * | 10/1999 |
| JP | 2001-272899 | A * | 10/2001 |

* cited by examiner

*Primary Examiner*—Joan Pendegrass
(74) *Attorney, Agent, or Firm*—Oliff & Berridge, PLC

(57) ABSTRACT

An image forming apparatus designed such that an intermediate transfer unit storage portion can be pulled in a horizontal direction from an accommodating portion of a casing and a processing unit storage portion, to which developing cartridges and a photosensitive belt mechanism are detachably attached, can be pulled from the intermediate transfer unit storage portion.

31 Claims, 10 Drawing Sheets

1

1

INTERMEDIATE TRANSFER TYPE IMAGE FORMING APPARATUS AND METHOD THEREOF

BACKGROUND OF THE INVENTION

1. Field of Invention

The invention relates to an intermediate transfer type color image forming apparatus.

2. Description of Related Art

There has been a color image forming apparatus that includes developing cartridges for yellow, magenta, cyan and black toners, a photosensitive medium, an intermediate transfer medium, and an transfer roller, in its casing.

First, a color-by-color visible image is sequentially formed on the photosensitive medium then transferred to the intermediate transfer medium by sequentially using yellow, magenta, cyan and black toners supplied by the respective developing cartridges. Thus, a color image is formed on the intermediate transfer medium. The color image is transferred onto a sheet by the transfer roller, and finally, a color image is formed on the sheet.

The developing cartridges can be attached to and detached from the image forming apparatus by opening a front cover of the casing. The photosensitive medium can also be attached to and detached from the image forming apparatus by opening an upper cover of the casing.

However, as described above, this structure requires opening different covers to attach/detach the parts to/from the image forming apparatus, resulting in making the replacement of the parts and maintenance of the image forming apparatus cumbersome and complicated.

SUMMARY OF THE INVENTION

The invention achieves simplification and speedup of the procedures for the replacement and maintenance of parts.

An image forming apparatus, in accordance with the invention, includes a developing device, a photosensitive medium and an intermediate transfer medium, in its casing. A processing unit includes the developing device and the photosensitive medium, and an intermediate transfer unit includes the intermediate transfer medium. The processing unit is attached to and detached from the intermediate transfer unit in a common direction when only the processing unit is removed from the casing and the intermediate transfer unit is attached to and detached from the casing in the common direction when the processing unit integrated with the intermediate transfer unit is removed from the casing.

Because the processing unit is detached from the casing separated from the intermediate transfer unit, maintenance can be performed on the developing device and the photosensitive medium. When the processing unit is detached from the casing integrated with the intermediate transfer unit, maintenance can be further performed on the intermediate transfer medium.

That is, the maintenance can be performed on all or any of the developing device, the photosensitive medium and the intermediate transfer medium in a single detaching/attaching operation. Thus, replacement and maintenance of the developing device, the photosensitive medium and the intermediate transfer medium can be easily and speedily performed.

The processing unit and the intermediate transfer unit can be detached and attached in the same direction, so that operability becomes high.

A feed unit can be detached and attached in the same direction as the attaching/detaching direction of the processing unit and the intermediate transfer unit. Accordingly the operability of the whole image forming apparatus can be improved.

The processing unit can be a combination of a developing device unit, on which the developing device is detachably attached, and a photosensitive medium unit, on which the photosensitive medium is attached with both units detachably attached to each other. In this structure, the developing device unit can designed so as to be detached and attached with respect to the casing integrated with or separated from the photosensitive medium unit.

BRIEF DESCRIPTION OF THE DRAWINGS

Exemplary embodiments of the invention will be described in detail with reference to the following figures wherein.

DETAILED DESCRIPTION OF PREFERRED EMBODIMENTS

Figure 1:
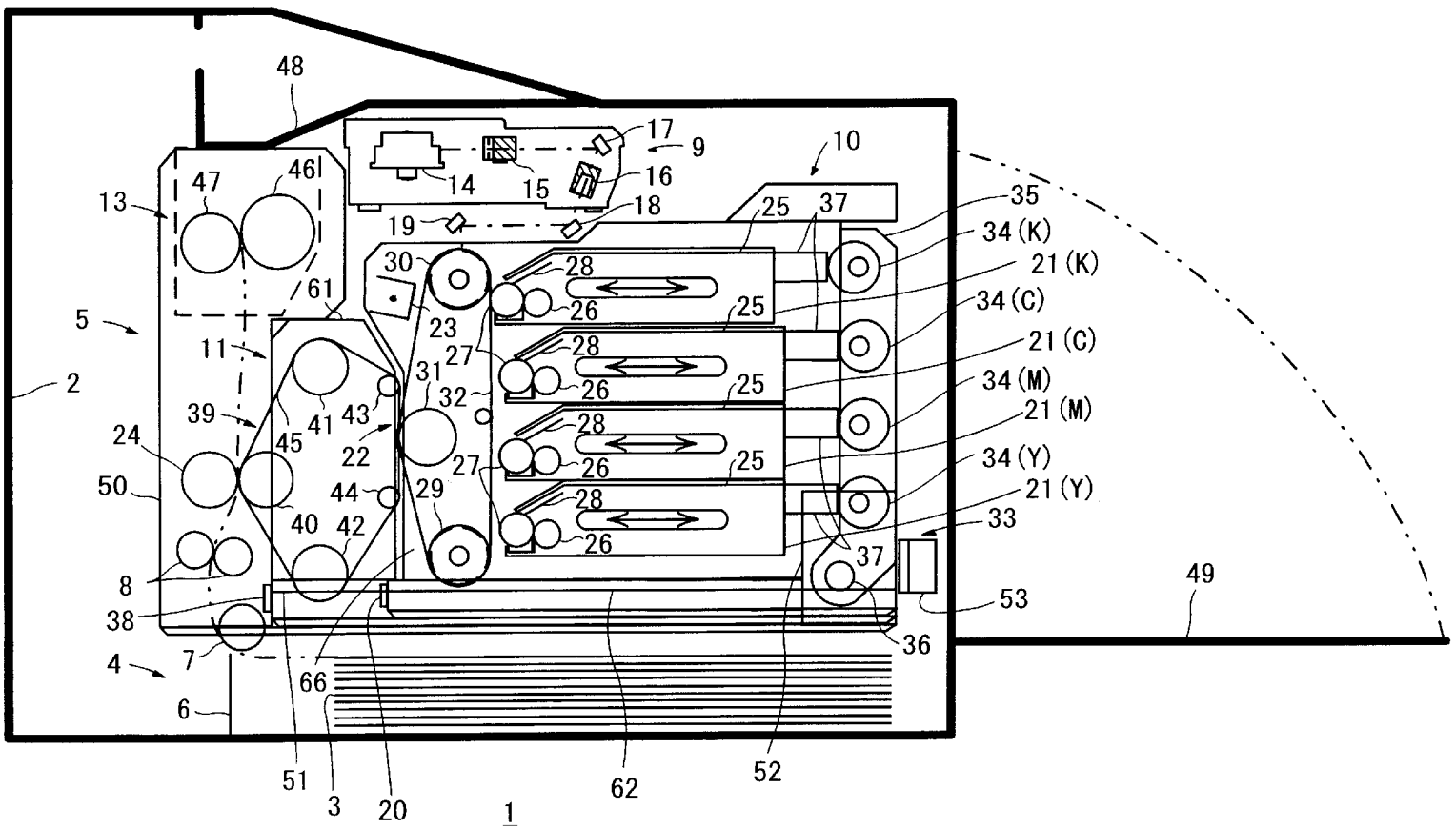
FIG. 1 is a sectional view showing a color laser-beam printer of an embodiment of the invention.

As shown in FIG. 1, a color laser-beam printer 1 includes a sheet feed unit 4 for feeding a sheet 3 and an image forming unit 5 for forming a predetermined image onto the sheet 3, in its casing 2.

The casing 2 has a cover 49 to open its rear. Hereinafter, the left and right of FIG. 1 are defined as the front and rear, respectively, and the directions are to be used throughout the drawings. The cover 49 is provided to a rear wall of the casing 2 so as to rotate about a lower end portion of the cover 49. The cover 49 can be rotated between a closing position where the cover 49 closes the rear wall of the casing 2 and an opening position where the cover 49 is placed in substantially a horizontal position and opens the rear wall of the casing 2.

The sheet feed unit 4 includes a sheet cassette 6, a sheet feed roller 7 and resist rollers 8. The sheet cassette 6 contains stacks of sheets 3 therein and is detachably attached to a lower part of the casing 2. The sheet cassette 6 can be pulled rearward from the casing 2 in a horizontal direction. The sheet feed roller 7 is rotatably supported by the casing 2 at an upper front of the sheet cassette 6. The resist rollers 8 include a driving roller and a following roller which are rotatably supported by the casing 2 above the sheet feed roller 7.

In a state where the sheet cassette 6 is attached to the casing 2, an uppermost sheet 3 in the sheet cassette 6 is fed by rotation of the sheet feed roller 7 from the stack, one by one. The resist rollers 8 correct deviation of the fed sheet 3, and then feed the sheet 3 to the image forming unit 5.

The image forming unit 5 includes a scanning unit 9, a processing unit 10, an intermediate transfer unit 11, a transfer roller 24 and a fixing unit 13.

The scanning unit 9 is fixed at the upper portion of the casing 2 and includes a laser emitting portion (not shown), a polygon mirror 14, lenses 15, 16 and reflectors 17, 18, 19. The laser emitting portion emits a laser beam based on image data. The laser beam passes or is reflected by the polygon mirror 14, the lens 15, the reflector 17, the lens 16, the reflectors 18 and 19 in order, and irradiates a surface of a photosensitive belt 32 described later.

The processing unit 10 includes a processing unit storage portion 20, four developing cartridges 21Y, 21M, 21C, 21K, a photosensitive belt mechanism 22 and a scorotron charging device 23.

The processing unit storage portion 20 is provided above the sheet cassette 6 so that the processing unit storage portion 20 can be attached and detached with respect to the casing 2. The developing cartridges 21Y, 21M, 21C, 21K and the photosensitive belt mechanism 22 are detachably mounted on the processing unit storage portion 20. The scorotron charging device 23 is fixedly supported by the processing unit storage portion 20.

The developing cartridges 21Y, 21M, 21C, 21K includes a yellow toner cartridge 21Y, a magenta toner cartridge 21M, a cyan toner cartridge 21C, and a black toner cartridge 21K for storing yellow, magenta, cyan and black toners, respectively. In the processing unit storage portion 20, the developing cartridges 21Y, 21M, 21C, 21K are aligned, in this order from below, in parallel to each other, at regular intervals, in the vertical direction. A projection 37 is provided to a rear wall of each of the developing cartridges 21Y, 21M, 21C, 21K so as to protrude in the rear direction.

The processing unit storage portion 20 is provided with a traversing mechanism 33 that moves the developing cartridges 21Y, 21M, 21C, 21K in the front and rear directions. The traversing mechanism 33 is disposed at the rear end portion of the processing unit storage portion 20, and includes a plurality of cams 34 and a cam frame 35. The cams 34 are provided behind the development cartridges 21 so as to be opposite to the respective development cartridges 21, and rotatably supported by the cam frame 35. The cams 34 include cams 34Y, 34M, 34C, 34K that face yellow, magenta, cyan and black toner cartridges 21Y, 21M, 21C, 21K, respectively.

The cams 34Y, 34M, 34C, 34K are rotatably supported by the cam frame 35 at a predetermined distance from each other in the vertical direction. The cams 34Y, 34M, 34C, 34K can engage with and disengage from the respective projections 37 of the developing cartridges 21Y, 21M, 21C, 21K. When the cams 34Y, 34M, 34C, 34K are selectively rotated by a drive force of a motor (not shown), the selected cam 34 pushes the opposite projection 37 and the developing cartridge 21 corresponding to the pushed projection 37 is moved in the front and rear direction.

The lower end portion of the cam frame 35 is rotatably supported by the processing unit storage portion 20 via a support shaft 36. The cam frame 35 can be rotated about the support shaft 36 between a standing position (FIG. 1) where the cams 34 engage the respective projections 37 and a laid position where the cam frame 35 is in substantially the horizontal position.

Figure 2:
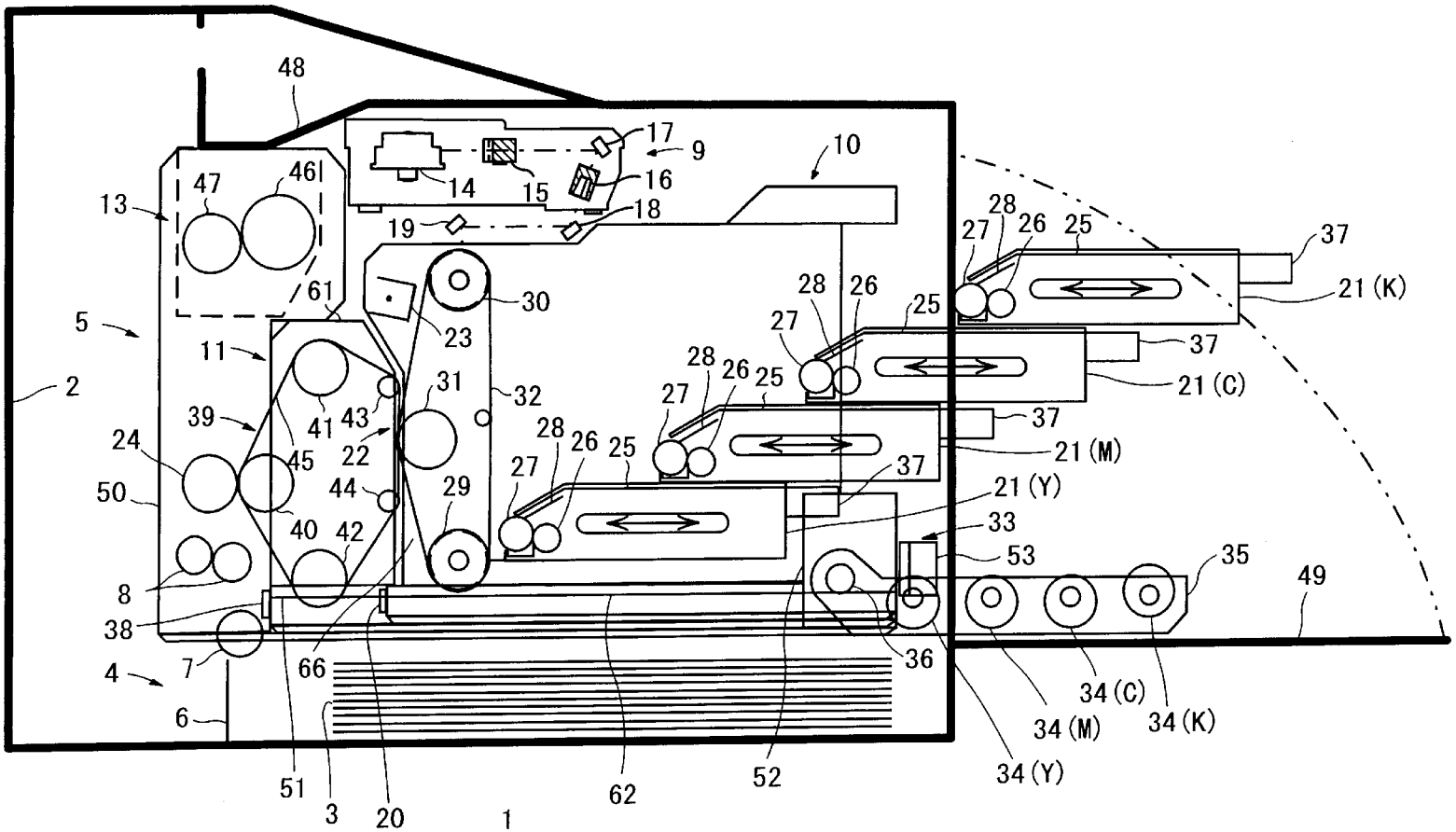
FIG. 2 is a diagram showing the color laser-beam printer with developing cartridges being detached or attached.

As shown in FIG. 2, in a state where the cover 49 is opened and the cam frame 35 is in the laid position, the developing cartridges 21Y, 21M, 21C, 21K can be pulled rearward in the horizontal direction, from the processing unit storage position 20. Thus, the developing cartridges 21Y, 21M, 21C, 21K can be detached and attached in the horizontal direction with respect to the processing unit storage portion 20.

Each of the developing cartridges 21Y, 21M, 21C, 21K includes a toner box 25, a supply roller 26, a developing roller 27 and a layer thickness-regulating blade 28. All of the developing cartridges 21Y, 21M, 21C, 21K have the same structure, so that only one of the developing cartridges 21Y, 21M, 21C, 21K will be described below.

The toner box 25 contains positively electrically charged polymerized toner of a single non-magnetic component. The toner box 25 of the yellow toner cartridge 21Y, the magenta toner cartridge 21M, the cyan toner cartridge 21C and the black toner cartridge 21K contains toner of the respective colors. The polymerized toner, produced by a polymerization method, have a spherical shape with a uniform diameter and excellent mobility.

The toner contained in the toner box 25 is supplied to the supply roller 26 by agitation by an agitator (not shown) provided in the toner box 25.

The supply roller 26 is rotatably provided at the front of and at the side of the toner box 25. The developing roller 27 is rotatably provided at the front of and at the side of the supply roller 26. The supply roller 26 is a metal shaft covered with a conductive sponge member. The developing roller 27 is a metal shaft covered with a conductive elastic member.

More specifically, the elastic member for the developing member 27 has two layers, one of which is made of urethane rubber, silicone rubber or EPDM rubber, to which conductivity is applied using carbon particles, and another of which is a coating layer that covers the surface of the former layer and is made of mainly, for example, urethane rubber, urethane resin, or polyimide resin. A predetermined amount of bias for development is applied to the developing roller 27. The supply roller 26 and the development roller 27 are in contact with each other so that the both rollers 26, 27 apply just the right amount of pressure to each other.

The layer thickness-regulating blade 28, which is a metal leaf spring member having a semicircular-shaped insulation urging portion made of silicone rubber at its free end, is provided above the developing roller 27. The other end of the leaf spring member is supported by the developing cartridge 21 and the urging portion of the leaf spring member urges the surface of the development roller 27 by an elastic force from the leaf spring member.

The toner is supplied from the toner box 25 to the development roller 27 by rotation of the supply roller 26. At that time, the toner becomes positively charged by friction caused between the supply roller 26 and the development roller 27. The toner supplied to the development roller 27 enters between the urging portion of the layer thickness-regulating blade 28 and the developing roller 27 by the rotation of the developing roller 27 and further charged by friction therebetween. Thus, the toner held by the developing roller 27 becomes a certain thickness.

Figure 3:
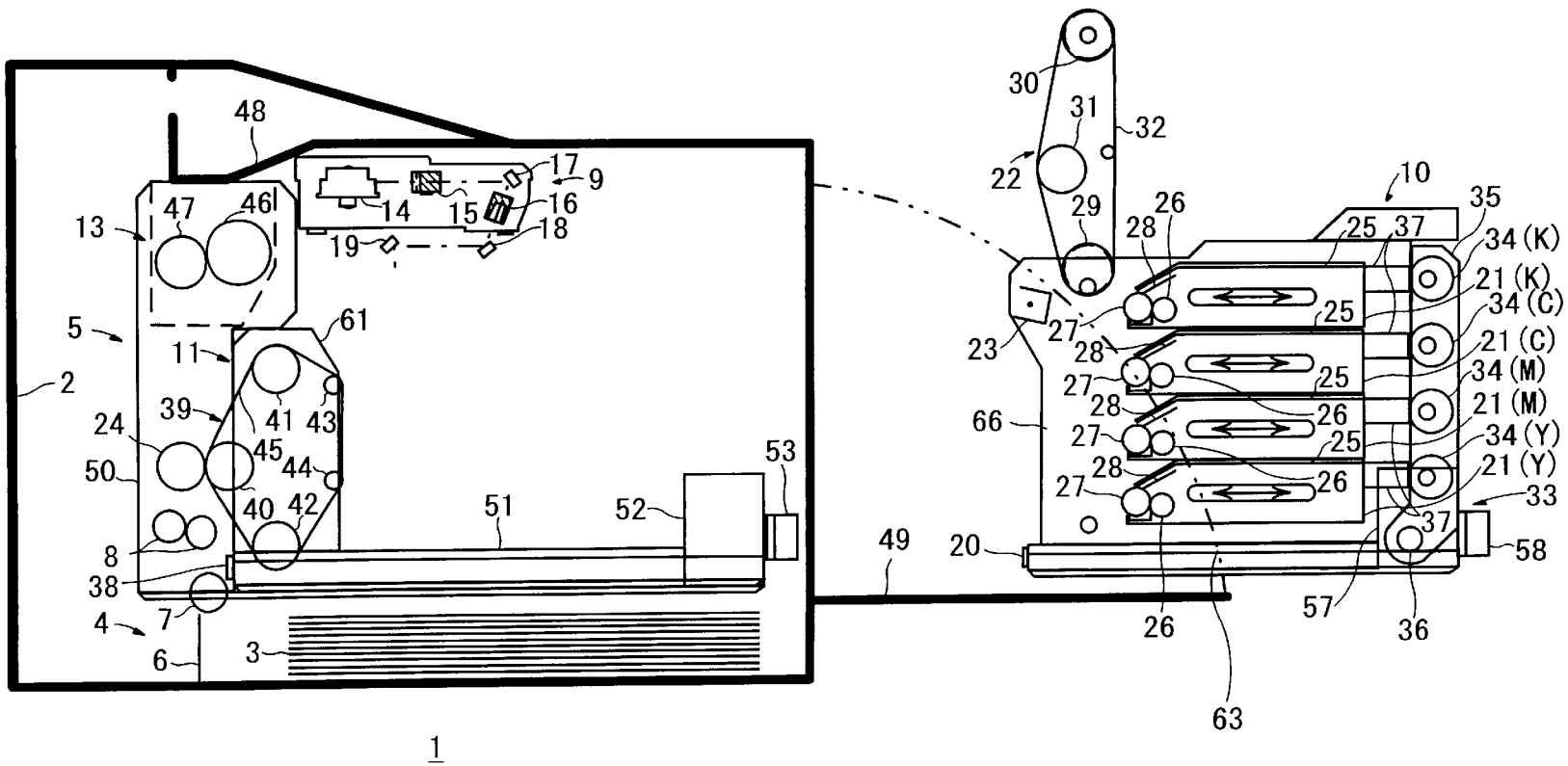
FIG. 3 is a diagram showing the color laser-beam printer with a processing unit being detached or attached.

As shown in FIG. 3, in a state where the processing unit storage portion 20 is pulled out of the color laser-beam printer 1, the photosensitive belt mechanism 22 can be pulled from (detached from and attached to) the processing unit storage portion 20 in the vertical direction.

The photosensitive belt mechanism 22 is disposed in front of and at the side of the developing cartridges 21Y, 21M, 21C, 21K so as to be opposite to the developing cartridges 21Y, 21M, 21C, 21K. The photosensitive belt mechanism 22 includes first, second and third photosensitive belt rollers 29, 30, 31 and a photosensitive belt 32.

The first photosensitive belt roller 29 is disposed to be opposite to the yellow toner cartridge 21Y located at the lowermost position. The second photosensitive belt roller 30 is disposed above the first photosensitive belt roller 29 so as to be substantially opposite to the black toner cartridge 21K located at the uppermost position. The third photosensitive belt roller 31 is disposed diagonally to the upper front of the first photosensitive belt roller 29 and diagonally to the lower front of the second photosensitive belt roller 30. The photosensitive belt 32 is wound around the first, second and third photosensitive belt rollers 29, 30, 31.

The photosensitive belt 32 is an endless belt made of resin, such as polycarbonate and polyimide, having conductivity to which conductive particles, such as carbon, are dispersed. An organic photosensitive layer is formed on the surface of the photosensitive belt 32.

The first, second and third photosensitive belt rollers 29, 30, 31 are disposed so as to take the form of a substantially elongated triangle. The photosensitive belt 32 is wound around the rollers 29, 30, 31. The length of the photosensitive belt 32 is longer than that of a maximum-size sheet which can be available in the color laser-beam printer 1.

The third photosensitive belt roller 31 is connected with a motor (not shown) by a gear and driven by the motor. The first and second photosensitive belt rollers 29, 30 are following rollers, which are rotated as the photosensitive belt 32 is moved by rotation of the third photosensitive belt roller 31 driven by the motor. Thus, the photosensitive belt 32 goes around the first, second and third photosensitive belt rollers 29, 30, 31.

The scorotron charging device 23 is fixedly supported at the upper front of the processing unit storage portion 20 and between the second and third photosensitive belt rollers 30 and 31, at a predetermined distance from the photosensitive belt 32 so as not to make contact therewith.

The scorotron charging device 23 generates corona discharge using tungsten wires and uniformly and positively charges the surface of the photosensitive belt 23.

The intermediate transfer unit 11 includes an intermediate transfer unit storage portion 38 and an intermediate transfer belt mechanism 39.

The intermediate transfer unit storage portion 38 is detachably attached with respect to the casing 2, above the sheet cassette 6. The intermediate transfer belt mechanism 39 is detachably attached to the intermediate transfer unit storage portion 38.

Figure 4:
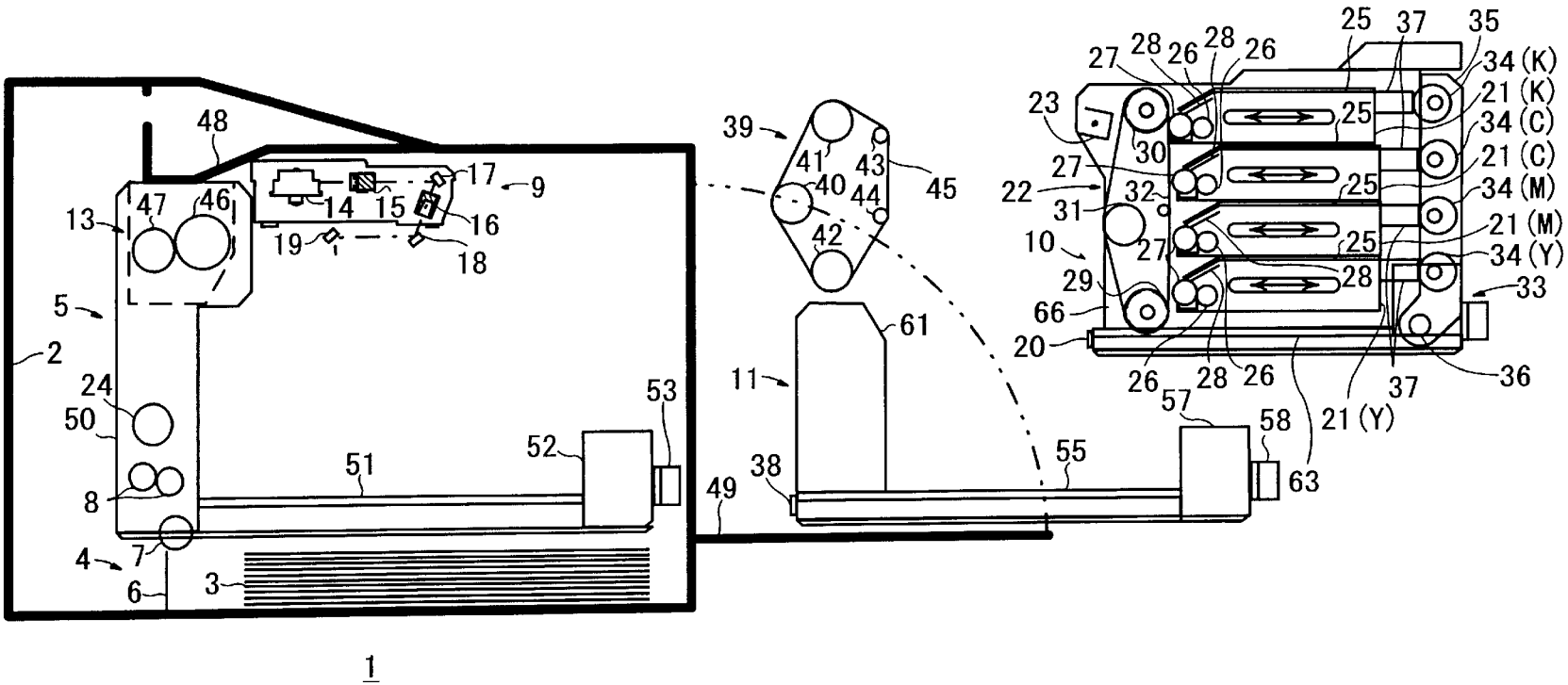
FIG. 4 is a diagram showing the color laser-beam printer with an intermediate transfer unit being detached or attached.

The intermediate transfer belt mechanism 39 can be detached and attached with respect to the intermediate transfer unit storage portion 38 in the vertical direction in a state where the intermediate transfer unit storage portion 38 is pulled out of the casing 2, as shown in FIG. 4.

The intermediate transfer belt mechanism 39 is disposed in front of and at the side of the photosensitive belt mechanism 22, and includes first, second and third intermediate transfer belt rollers 40, 41, 42, tension rollers 43, 44, and an intermediate transfer belt 45.

The first intermediate transfer belt roller 40 is disposed so as to be opposite to the transfer roller 24 described below. The second intermediate transfer belt roller 41 is disposed diagonally upper rear of the first intermediate transfer belt roller 40. The third intermediate transfer belt roller 42 is disposed under the second intermediate transfer belt roller 41 and diagonally lower rear of the first intermediate transfer belt roller 40. The tension rollers 43, 44 are disposed behind the second and third intermediate transfer belt rollers 41, 42, at a predetermined distance from each other. The intermediate transfer belt 45 is wound around the first, second and third intermediate transfer belt rollers 40, 41, 42 and the tension rollers 43, 44.

The intermediate transfer belt 45 is an endless belt made of resin, such as polycarbonate and polyimide, having conductivity, to which conductive particles, such as carbon, are applied.

The first, second and third intermediate transfer belt rollers 40, 41, 42 and the tension rollers 43, 44 are disposed so as to substantially form a pentagon and the intermediate transfer belt 45 is wound around them. The intermediate transfer belt 45 is disposed opposite to the first photosensitive belt roller 29 so as to make contact with the photosensitive belt 32 between the tension rollers 43 and 44 while sandwiching the photosensitive belt 32 therebetween.

The first intermediate transfer belt 45 is connected with a motor (not shown) by a gear and driven by the motor. The second and third intermediate transfer belt rollers 41, 42 and tension rollers 43, 44 are following rollers, which are rotated as the intermediate transfer belt 45 is moved by rotation of the first intermediate transfer belt roller 40 driven by the motor.

Thus, the intermediate transfer belt 45 goes around the first, second and third intermediate transfer belt rollers 40, 41, 42 and the tension rollers 43, 44, as the first intermediate transfer belt roller 40 rotates.

The transfer roller 24 is rotatably supported by the casing 2 in front of and at the side of the intermediate transfer belt mechanism 39 so as to be opposite to the first intermediate transfer belt roller 40. The intermediate transfer belt 45 is disposed between the transfer roller 24 and the first intermediate transfer belt roller 40. The transfer roller 24 is applied a predetermined bias for transfer.

The surface of the photosensitive belt 32 is uniformly positively charged by the scorotron charging device, and then exposed by a laser beam from the scanner unit 9. Thus, an electrostatic latent image is formed on the surface of the photosensitive belt 32 based on image data.

Then, the cams 34 are selectively driven to move the developing cartridges 21 and the developing roller 27 contacts the photosensitive belt 32. Toner held by the developing roller 27 adheres to the electrostatic latent image on the photosensitive belt 32, and thus, a visible image is formed on the photosensitive belt 32 in monochrome. Then, the monochrome visible image on the photosensitive belt 32 is transferred onto the intermediate transfer belt 45 when the image faces the intermediate transfer belt 45.

First, when the cam 34Y is driven, the yellow toner cartridge 21Y located at the lowermost position is moved forward in the horizontal direction. At that time, the magenta, cyan and black toner cartridges 21M, 21C, 21K are retained at the position behind the yellow toner cartridge 21Y in the horizontal direction, using the cams 34M, 34C, 34K, respectively. Then, only the developing roller 27 of the yellow toner cartridge 21Y contacts the photosensitive belt 32 and the developing rollers 27 of the other cartridges 21M, 21C, 21K are held at some distance from the photosensitive belt 32.

As a result, yellow toner stored in the yellow toner cartridge 21Y adheres to the electrostatic latent image on the photosensitive belt 32 and a visible image is formed in yellow. When the yellow visible image faces the intermediate transfer belt 45 by rotation of the photosensitive belt 32, the yellow visible image is transferred onto the intermediate transfer belt 45.

Likewise, after an electrostatic latent image for magenta is formed on the photosensitive belt 32, the cam 34M is driven to move the magenta toner cartridge 21M, which is located above the yellow toner cartridge 21Y, forward in the horizontal direction. At that time, the yellow, cyan and black toner cartridges 21Y, 21C, and 21K are retained at the position behind the magenta toner cartridge 21M in the horizontal direction. Only the developing roller 27 of the magenta toner cartridge 21M contacts the photosensitive belt 32 and the developing rollers 27 of the other cartridges 21Y, 21C, 21K are held at some distance from the photosensitive belt 32.

Then, magenta toner stored in the magenta toner cartridge 21M adheres to the electrostatic latent image on the photosensitive belt 32 and a visible image is formed in magenta. When the magenta visible image faces the intermediate transfer belt 45 by rotation of the photosensitive belt 32, the magenta visible image is transferred onto the intermediate transfer belt 45 having the yellow toner image thereon.

The same procedures are performed using cyan toner stored in the cyan toner cartridge 21C and black toner stored in the black toner cartridge 21K. As a result, a color image is formed by the four toners on the intermediate transfer belt 45.

FIG. 1 shows a state where the developing roller 27 of the black toner cartridge 21K contacts the photosensitive belt 32 and those of the other cartridges 21Y, 21M, 21C are held at some distance from the photosensitive belt 32.

The color image, formed on the intermediate transfer belt 45 as described above, is transferred onto the sheet 3 while the sheet 3 passes between the intermediate transfer belt 45 and the transfer roller 24.

The fixing unit 13 is provided at the upper portion of the casing 2 and above the intermediate transfer belt mechanism 39, and includes a heat roller 46 and an urging roller 47 that urges the heat roller 46. The heat roller 46 is a hollow metal roller having a halogen lamp therein and is used to fix the transferred color image on the sheet 3 by heat while the sheet 3 passes between the heat roller 46 and the urging roller 47. The sheet 3, on which the color image is fixed, is to be ejected onto a tray 48 provided at the top of the casing 2.

In the color laser-beam printer 1, the processing unit storage portion 20 and the intermediate transfer unit storage portion 38 are detachably attached with respect to the casing 2.

Figure 5:
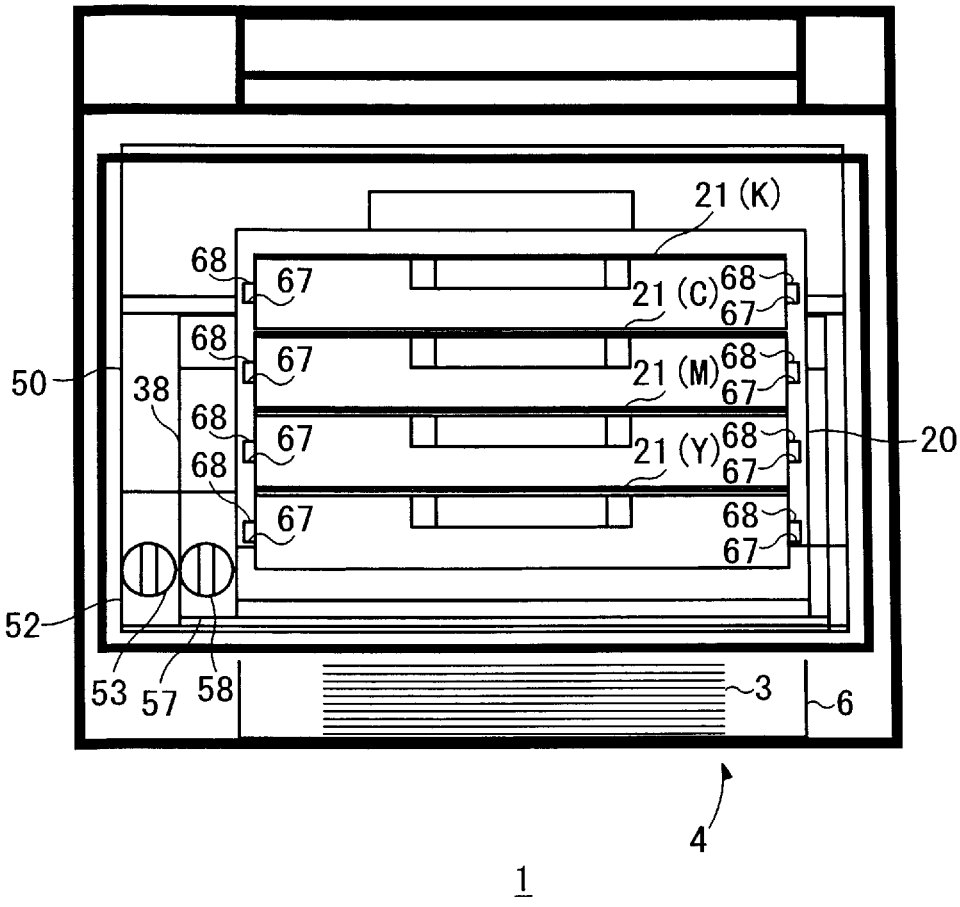
FIG. 5 is a rear view of the color laser-beam printer.
Figure 6:
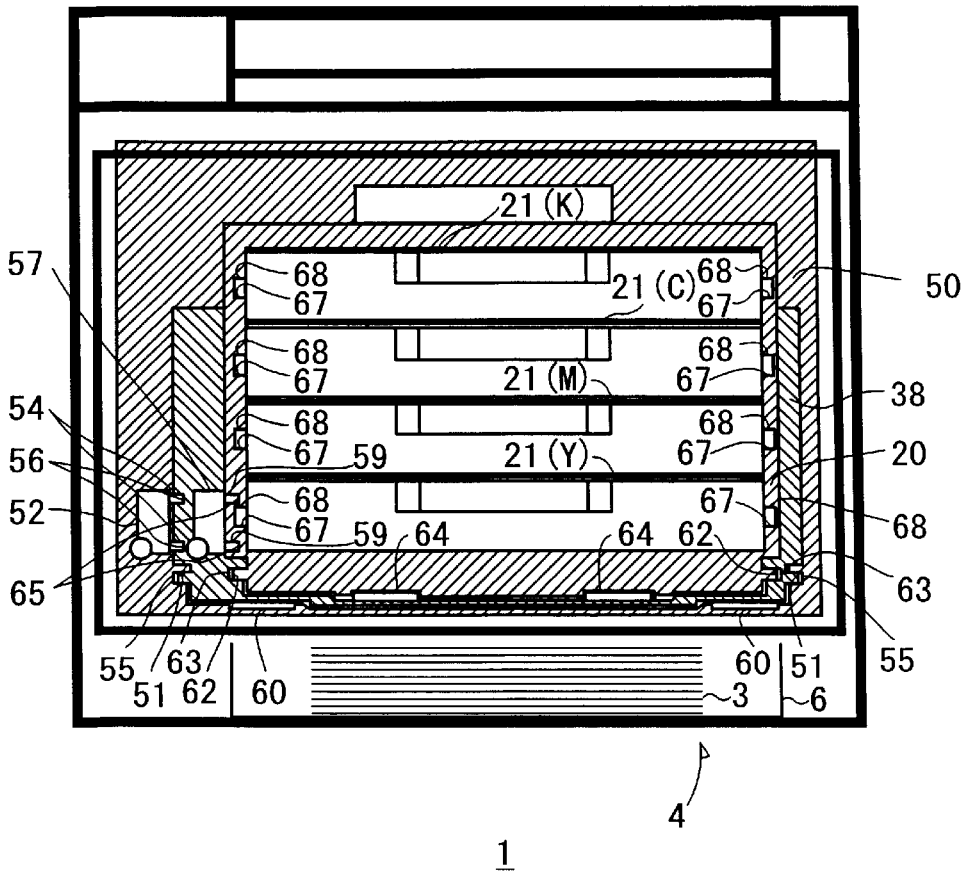
FIG. 6 is a rear sectional view showing the color laser-beam printer.

As shown in FIGS. 4 to 6, an accommodating portion 50 is provided above the sheet feed unit 4, in the casing 2, to receive the intermediate transfer unit storage portion 38. As shown in FIG. 6, the accommodation portion 50, having a rectangular prism shape, can accommodate the intermediate transfer unit storage portion 38 therein. A guide groove 51, extending substantially in the horizontal direction, is provided to side walls of the accommodating portion 50. The guide grooves 51 guide the intermediate transfer unit storage portion 38 when the intermediate transfer unit storage portion 38 is attached to and detached from the accommodating portion 50.

A first locking mechanism 52 is provided at one side of the rear of the accommodating portion 50 to lock the intermediate transfer unit storage portion 38 with respect to the accommodating portion 50.

As shown in FIGS. 5 and 6, the first locking mechanism 52 includes a rotatable pinching portion 53 and two engaging protrusions 54. The engaging protrusions 54 retract in the inward direction of the casing 2 in synchronization with rotation of the pinching portion 53. The pinching portion 53 can be placed at a first position when the intermediate transfer unit storage portion 38 is locked and a second position when intermediate transfer unit storage portion 38 is unlocked, by the rotation of the pinching portion 53.

The first locking mechanism 52 protrudes the engaging protrusions 54 by rotating the pinching portion 53 to the first position to lock the intermediate transfer unit storage portion 38 with respect to the accommodating portion 50, and retracts the engaging protrusions 54 by rotating the pinching portion 53 to the second position to unlock the intermediate transfer unit storage portion 38 with respect to the accommodating portion 50. FIGS. 5 and 6 show a state where the intermediate transfer storage portion 38 is locked in the accommodating portion 50 by protruding the engaging protrusions 54. When the pinching portion 53 is rotated 90 degrees from this state to the first position, the engaging protrusions 54 retract and the lock is released.

As shown in FIGS. 4 to 6, the intermediate transfer unit storage portion 38 has a substantially C-shape so as to accommodate the processing unit storage portion 20. The intermediate transfer unit storage portion 38 has side walls and a bottom wall and no upper wall. As shown in FIG. 6, a projection 55, extending from one side to another side in the horizontal direction, is provided to the side walls of the intermediate transfer unit storage portion 38. The projections 55 slidably engage the guide grooves 51 of the accommodating portion 50.

The intermediate transfer unit storage portion 38 is provided with rollers 60 at its bottom wall so that the intermediate transfer unit storage portion 38 can be smoothly attached and detached with respect to the casing 2.

The side wall, facing the first locking mechanism 52, of the intermediate transfer unit storage portion 38 has two engagement grooves 56 that receive the engaging protrusions 54 of the first locking mechanism 52. In a state where the intermediate transfer unit storage portion 38 is accommodated in the accommodating portion 50, the engagement grooves 56 are opposite to the engaging protrusions 54 of the first locking mechanism 52.

When the first locking mechanism 52 locks the intermediate transfer unit storage portion 38 in the accommodating portion 50, the engaging protrusions 54 protrude and engage the respective engagement grooves 56. Therefore, with respect to the casing 2, the movement of the intermediate transfer unit storage portion 38 is restricted and the intermediate transfer unit 11 is fixed. When the first locking mechanism 52 releases the locking of the intermediate transfer unit storage portion 38, the engaging protrusions 54 retract from the engagement grooves 56. Thus, the intermediate transfer unit storage portion 38 becomes free from the restriction with respect to the accommodating portion 50 and can be detached and attached with respect to the casing 2.

A second locking mechanism 57 is provided at one side of the rear of the intermediate transfer unit storage portion 38 to lock the processing unit storage portion 20 with respect to the intermediate transfer unit storage portion 38.

As shown in FIGS. 5 and 6, the second locking mechanism 57 includes a rotatable pinching portion 58 and two engaging protrusions 59. The engaging protrusions 59 retract in the inward direction of the casing 2 in synchronization with rotation of the pinching portion 58. The pinching portion 58 can be moved between a first position when the processing unit storage portion 20 is locked and a second position when the processing unit storage portion 20 is unlocked.

The second locking mechanism 57 protrudes the engaging protrusions 59 by rotating the pinching portion 58 to the first position to lock the processing unit storage portion 20 and retracts the engaging protrusions 59 by rotating the pinching portion 58 to the second position to unlock the processing unit storage portion 20. FIGS. 5 and 6 show a state where the processing unit storage portion 20 is locked in the intermediate transfer unit storage portion 38 by protruding the engaging protrusions 59. In this state, when the pinching portion 58 is rotated 90 degrees to the second position, the engaging protrusions 59 retract and the lock is released.

A guide groove 62, extending substantially in the horizontal direction, is provided to the side walls of the intermediate transfer unit storage portion 38. The guide grooves 62 guide the processing unit storage portion 20 when the processing unit storage portion 20 is attached to and detached from the intermediate transfer unit storage portion 38.

As shown in FIG. 4, an intermediate transfer belt storage portion 61 is provided at the front end of the intermediate transfer unit storage portion 38 to accommodate the intermediate transfer belt mechanism 39 therein. As described above, the intermediate transfer belt mechanism 39 is detachably attached to the intermediate transfer belt storage portion 61.

As shown in FIGS. 4 to 6, the processing unit storage portion 20 has a rectangular prism shape so as to accommodate the developing cartridges 21Y, 21M, 21C, 21K and the photosensitive belt mechanism 22. The processing unit storage portion 20 has side walls that is provided with a projection 63, extending from one side to another side in the horizontal direction. The projections 63 slidably engage the guide grooves 62 of the intermediate transfer unit storage portion 38.

The processing unit storage portion 20 is provided with rollers 64 at its bottom wall so that the processing unit storage portion 20 can be smoothly attached and detached with respect to the intermediate transfer unit storage portion 38.

The side wall, facing the second locking mechanism 57, of the processing unit storage portion 20 has two engagement grooves 65 that receive the engaging protrusions 59 of the second locking mechanism 52. In a state where the processing unit storage portion 20 is accommodated in the intermediate transfer unit storage portion 38, the engagement grooves 65 are opposite to the engaging protrusions 59 of the second locking mechanism 57.

When the second locking mechanism 57 locks the processing unit storage portion 20 in the intermediate transfer unit storage portion 38, the engaging protrusions 59 protrude and engage the respective engagement grooves 65. Therefore, with respect to the intermediate transfer unit storage portion 38, the movement of the processing unit storage portion 20 is restricted. Further, the processing unit 10 can be detached and attached, with respect to the casing 2, and integrated with the intermediate transfer unit 11. When the second locking mechanism 57 unlocks the processing unit storage portion 20, the engaging protrusions 59 retract from the engagement grooves 65. Thus, the processing unit storage portion 20 becomes free from the restriction with respect to the intermediate transfer unit storage portion 38, and the processing unit 10 can be detached and attached, with respect to the casing 2 and the intermediate transfer unit I1, and separated from the intermediate transfer unit 11.

As shown in FIG. 6, the first and second locking mechanisms 52, 57 are disposed in parallel with each other in a state where the intermediate transfer unit storage portion 38 is stored in the accommodating portion 50.

As shown in FIG. 3, a photosensitive belt storage portion 66 is provided at the front end of the processing unit storage portion 20 to accommodate the photosensitive belt mechanism 22, which is detachably attached to the photosensitive belt storage portion 66.

As shown in FIG. 6, guide grooves 67 are provided in the side walls of the processing unit storage portion 20 at the rear of the photosensitive belt storage portion 66. The guide grooves 67 guide the developing cartridges 21Y, 21M, 21C, 21K when the cartridges 21Y, 21M, 21C, 21K are detached therefrom and attached thereto. The guide groves 67 extend in substantially the horizontal direction, corresponding to the respective developing cartridges 21Y, 21M, 21C, 21K.

Both side walls of each of the cartridges 21Y, 21M, 21C, 21K have projections 68 that protrude and slidably engage the guide grooves 67. The projections 68 extend from one side to another side in the horizontal direction.

When the cartridges 21Y, 21M, 21C, 21K are removed from the color laser-beam printer 1, as shown in FIG. 2, first, the cover 49 is opened, and then the cam frame 35 is brought into the laid position. After that, the cartridges 21Y, 21M, 21C, 21K are pulled backward in the horizontal direction from the processing unit storage portion 20. In each of the cartridges 21Y, 21M, 21C, 21K, the projections 68 are slidably engaged with the guide grooves 67, so that the cartridges 21Y, 21M, 21C, 21K can be easily and surely move in the horizontal direction along the guide grooves 67. When the cartridges 21Y, 21M, 21C, 21K are attached to color laser-beam printer 1, the projections 68 of the cartridges 21Y, 21M, 21C, 21K are brought into engagement with the guide grooves 67 of the processing unit storage portion 20, and then the cartridges 21Y, 21M, 21C, 21K are pushed forward in the horizontal direction.

When the photosensitive belt mechanism 22 is removed, as shown in FIG. 3, first, the cover is opened, and then the second locking mechanism 57 releases the locking of the processing unit storage portion 20 while the first locking mechanism 52 locks the intermediate transfer unit storage portion 38 with respect to the casing 2. By doing so, the processing unit storage portion 20 can be separated from the intermediate transfer unit storage portion 38 and attached and detached with respect to the intermediate transfer unit storage portion 38. The processing unit storage portion 20 is pulled backward in the horizontal direction from the intermediate transfer unit storage portion 38, and then the photosensitive belt mechanism 22 is upwardly pulled out of the photosensitive belt storage portion 66 of the processing unit storage portion 20.

In order to attach the photosensitive belt mechanism 22, the photosensitive belt mechanism 22 is inserted into the photosensitive belt storage portion 66 from above. Then, the projections 63 of the processing unit storage portion 20 are engaged with the guide grooves 62 of the intermediate transfer unit storage portion 38. In this state, the processing unit storage portion 20 is pushed forward in the horizontal direction, and then, the second locking mechanism 57 locks the processing unit storage portion 20.

When the intermediate transfer belt mechanism 39 is removed, as shown in FIG. 4, first, the cover 49 is opened, and then the first and second locking mechanisms 52, 57 unlocks the intermediate transfer unit storage portion 38 and the processing unit storage portion 20, respectively. As the first locking mechanism 52 release the lock, the intermediate transfer unit storage portion 38 can be attached and detached with respect to the casing 2. As the second locking mechanism 57 releases the lock, the processing unit storage portion 20 can be separated from the intermediate transfer unit storage portion 38 and detached and attached with respect to the intermediate transfer unit storage portion 38.

The intermediate transfer unit storage portion 38 is pulled backward in the horizontal direction, from the casing 2, and the processing unit storage portion 20 is pulled backward in the horizontal direction, from the intermediate transfer unit storage portion 38. Then, the processing unit storage portion 20 is removed from the intermediate transfer unit storage portion 38. After that, the intermediate transfer belt mechanism 39 is pulled upward from the intermediate transfer belt storage portion 61 of the intermediate transfer unit storage portion 38.

When the intermediate transfer belt mechanism 39 is attached, first, the intermediate transfer belt mechanism 39 is inserted into the intermediate transfer belt storage portion 61 from above, and the projections 63 of the processing unit storage portion 20 are engaged with the guide grooves 62 of the intermediate transfer unit storage portion 38. In this state, the processing unit storage portion 20 is pushed forward in the horizontal direction, with respect to the intermediate transfer unit storage portion 38 to attach the processing unit storage portion 20 to the intermediate transfer unit storage portion 38. Then, the projections 55 of the intermediate transfer unit storage portion 38 are engaged with the guide grooves 51 of the accommodating portion 50, and the intermediate transfer unit storage portion 38 is pushed forward in the horizontal direction, with respect to the accommodating portion 50, to attach the intermediate transfer unit storage portion 38 to the accommodating portion 50. After that, the first and second locking mechanisms 52, 57 locks the intermediate transfer unit storage portion 38 and the processing unit storage portion 20.

The detachment and attachment of the intermediate transfer unit storage portion 38 can be performed in a state where the first locking mechanism 52 unlocks the intermediate transfer unit storage portion 38 and the second locking mechanism 57 locks the processing unit storage portion 20. Without removing the processing unit storage portion 20 from the intermediate transfer unit storage portion 38, the intermediate transfer unit storage portion 38 is pulled out rearward in the horizontal direction with integrated with the processing unit storage portion 20. Then, the intermediate transfer belt mechanism 39 can be detached and attached with respect to the intermediate transfer belt storage portion 61.

In the color laser-beam printer 1, the processing unit storage portion 20 and the intermediate transfer unit storage portion 38 can be detached and attached in a common direction (rearward and forward in the horizontal direction) with respect to the casing 2. When the first and second locking mechanisms 52, 57 selectively perform locking and unlocking, the processing unit storage portion 20 can be detached and attached with respect to the accommodating portion 50 of the casing 2, with integrated with or separated from the intermediate transfer unit storage portion 38.

When the processing unit storage portion 20 is separated from the intermediate transfer unit storage portion 38 and pulled rearward in the horizontal direction with respect to the accommodating portion 50, the maintenance can be performed on the cartridges 21Y, 21M, 21C, 21K and the photosensitive belt mechanism 22. When the processing unit storage portion 20 is pulled rearward in the horizontal direction with respect to the accommodating portion 50 and integrated with the intermediate transfer unit storage portion 38, the maintenance can be performed on the intermediate transfer belt mechanism 39.

Accordingly, the maintenance can be performed on all or any of the cartridges 21Y, 21M, 21C, 21K, the photosensitive belt mechanism 22 and the intermediate transfer belt mechanism 39, in a single attaching/detaching operation. Thus, the replacement and the maintenance of the parts can be easily and speedily performed.

When the first locking mechanism 52 locks the intermediate transfer unit storage portion 38 and the second locking mechanism 57 unlocks the processing unit storage portion 20, only the processing unit storage portion 20 can be separated and detached and attached while the intermediate transfer unit storage portion 38 is fixed with respect to the accommodating portion 50.

When the first locking mechanism 52 unlocks the intermediate transfer unit storage portion 38 and the second locking mechanism 57 locks the processing unit storage portion 20, the intermediate transfer unit storage portion 38 can be detached and attached with respect to the accommodating portion 50 while the processing unit storage portion 20 is fixed with respect to the intermediate transfer unit storage portion 38.

That is, only by selectively locking or unlocking using the first and second locking mechanisms 52, 57 as necessary, only required parts can be replaced and/or maintained.

In the state where the processing unit storage portion 20 and the intermediate transfer unit storage portion 38 are attached, the first and second locking mechanisms 52, 57 lock the intermediate transfer unit storage portion 38 and the processing unit storage portion 20, respectively, by which the engaging protrusions 54, 59 protrude into the engagement grooves 56, 65 and unlock them by which the engaging protrusions 54, 59 retract from the engagement grooves 56, 65.

When the processing unit storage portion 20 and the intermediate transfer unit storage portion 38 are not appropriately attached, the engaging protrusions 54, 59 do not face the engagement grooves 56, 65. Therefore, the first and second locking mechanisms 52, 57 cannot lock the intermediate transfer unit storage portion 38 and the processing unit storage portion 20, respectively. Accordingly, it can be easily checked whether the processing unit storage portion 20 and the intermediate transfer unit storage portion 38 are appropriately attached, and the color laser-beam printer 1 can be prevented from performing undesirable operation.

The four developing cartridges 21Y, 21M, 21C, 21K can be independently attached to and detached from the processing unit storage portion 20. Therefore, the maintenance can be easily performed on the developing cartridges 21Y, 21M, 21C, 21K by the cartridge.

The photosensitive belt mechanism 22 is detachably attached to the photosensitive belt storage portion 66 of the processing unit storage portion 20. With this structure, the photosensitive belt mechanism 22 can be detached from and attached to the processing unit storage portion 20. Thus, the maintenance of the photosensitive belt mechanism 22 is simplified.

The processing unit storage portion 20 is attached with the developing cartridges 21Y, 21M, 21C, 21K and the photosensitive belt mechanism 22, and the intermediate transfer unit storage portion 38 is attached with the intermediate transfer belt mechanism 39. The processing unit storage portion 20 and the intermediate transfer unit storage portion 38 are pulled in the same direction, so that the developing cartridges 21Y, 21M, 21C, 21K, the photosensitive belt mechanism 22, and the intermediate transfer belt mechanism 39 can be easily and speedily attached to and detached from their predetermined positions. Further, efficiency of the replacement and the maintenance of the parts can be improved.

The traversing direction of the developing cartridges 21Y, 21M, 21C, 21K by the cams 34Y, 34M, 34C, 34K is the same as the pulling direction of the processing unit storage portion 20 and the intermediate transfer unit storage portion 38, so that the structure of the color laser-beam printer 1 can be simplified. The pulling direction of the sheet cassette 6 is also the same as the pulling direction of the processing unit storage portion 20 and the intermediate transfer unit storage portion 38, so that operability of the color laser-beam printer 1 can be further improved.

Figure 7A:
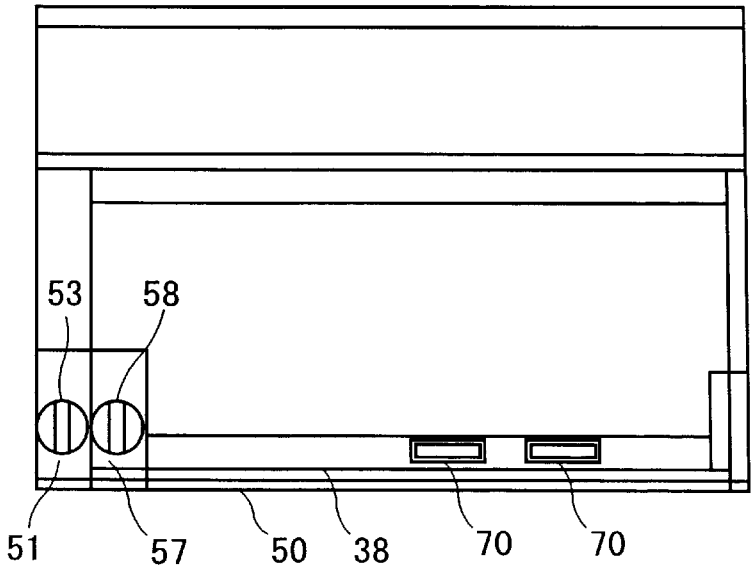
FIG. 7A is a rear view of an intermediate transfer storage portion.
Figure 7B:
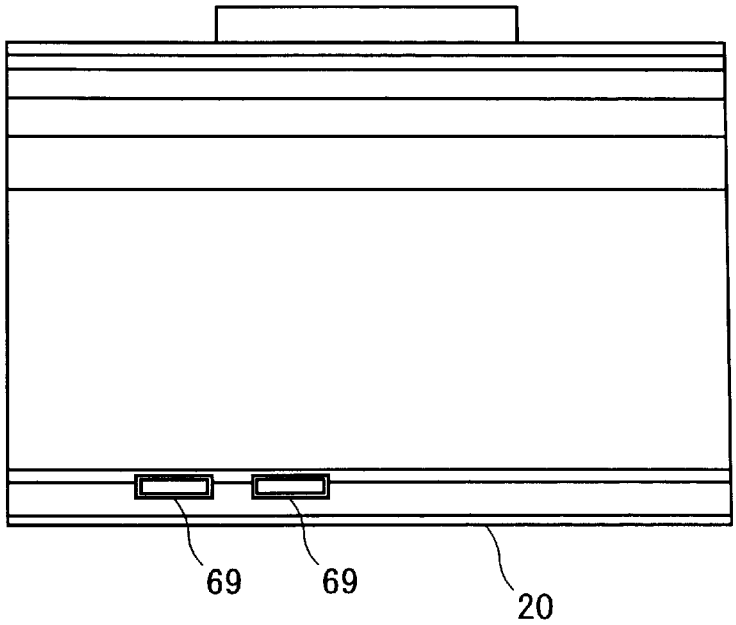
FIG. 7B is a front view of a processing unit storage portion.
Figure 8:
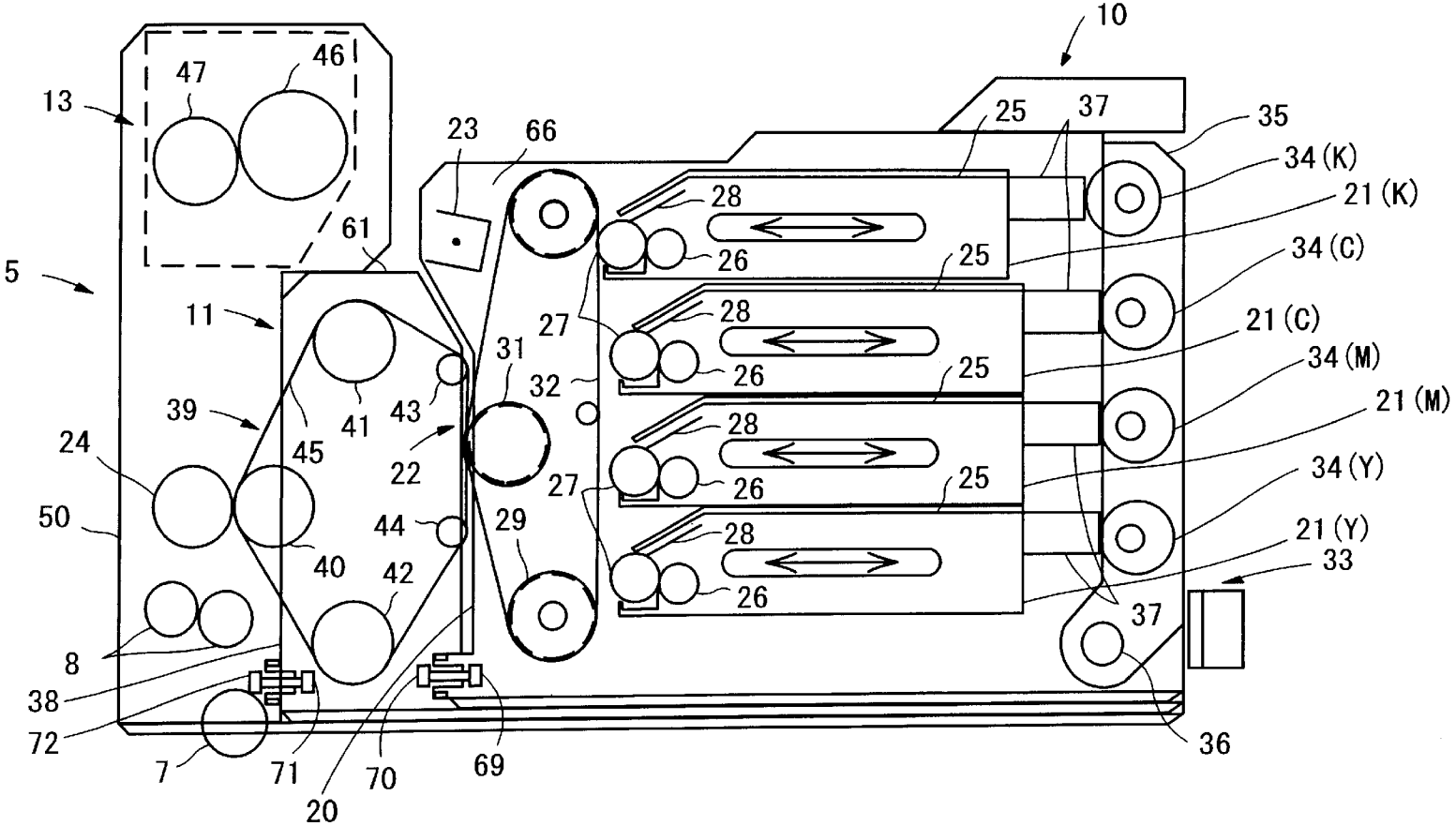
FIG. 8 is a diagram showing an accommodating portion provided in the color laser-beam printer, and a connection of terminals of the intermediate transfer unit storage portion and the processing unit storage portion.

As shown in FIGS. 7A to 8, two processing unit side input terminals 69 are provided at the front of the lower portion of the processing unit storage portion 20. The input terminals 69 expose and are aligned in parallel with each other to supply power to electrical systems for each part mounted on the processing unit storage portion 20. Two intermediate transfer unit side output terminals 70 corresponding to the input terminals 69 are provided at the back of the lower portion of the intermediate transfer unit storage portion 38 so as to expose and be aligned in parallel with each other.

When the processing unit storage portion 20 is attached to the intermediate transfer unit storage portion 38, the processing unit side input terminals 69 and the intermediate transfer unit side output terminals 70 are connected with each other.

The input terminals 69 and the output terminals 70 are used to supply a development bias to be applied to the shaft of the developing roller 27 and power to a motor driving the cams 34Y, 34M, 34C, 34K.

Two intermediate transfer unit side input terminals 71 are provided at the front of the lower portion of the intermediate transfer unit storage portion 38. The input terminals 71 expose and are aligned in parallel with each other to supply power to electrical systems for each part mounted on the intermediate transfer unit storage portion 38. Two printer body side output terminals 72 corresponding to the input terminals 71 are provided at the back of the lower portion of the accommodating portion 50 so as to expose and be aligned in parallel with each other.

When the intermediate transfer unit storage portion 38 is attached to the accommodating portion 50, the input terminals 71 and the output terminals 70 are connected with each other.

As shown in FIG. 8, when the intermediate transfer unit storage portion 38 is attached to the accommodating portion 50 first, the intermediate transfer side input terminals 71 and the printer body side output terminals 72 are connected with each other, so that the intermediate transfer unit storage portion 38 can be electrically connected with the accommodating portion 50. Further, in this state, when the processing unit storage portion 20 is attached to the intermediate transfer unit storage portion 38, the processing unit side input terminals 69 and the intermediate transfer side output terminals 70 are connected with each other. Thus, the processing unit storage portion 20 can be electrically connected with the accommodating portion 50 via the intermediate transfer unit storage portion 38.

With this structure, it is unnecessary to electrically connect the intermediate transfer unit storage portion 38 with the accommodating portion 50 additionally using, for example, a harness, after the intermediate transfer unit storage portion 38 is attached to the accommodating portion 50. Therefore, the attaching and detaching operation of the intermediate transfer unit storage portion 38 can be simplified. Further, it is unnecessary to electrically connect the processing unit storage portion 20 with the intermediate transfer unit storage portion 38 additionally using, for example, a harness, after the processing unit storage portion 20 is attached to the intermediate transfer unit storage portion 38. Accordingly, the attaching and detaching operation of the processing unit storage portion 20 can be also simplified.

Figure 9:
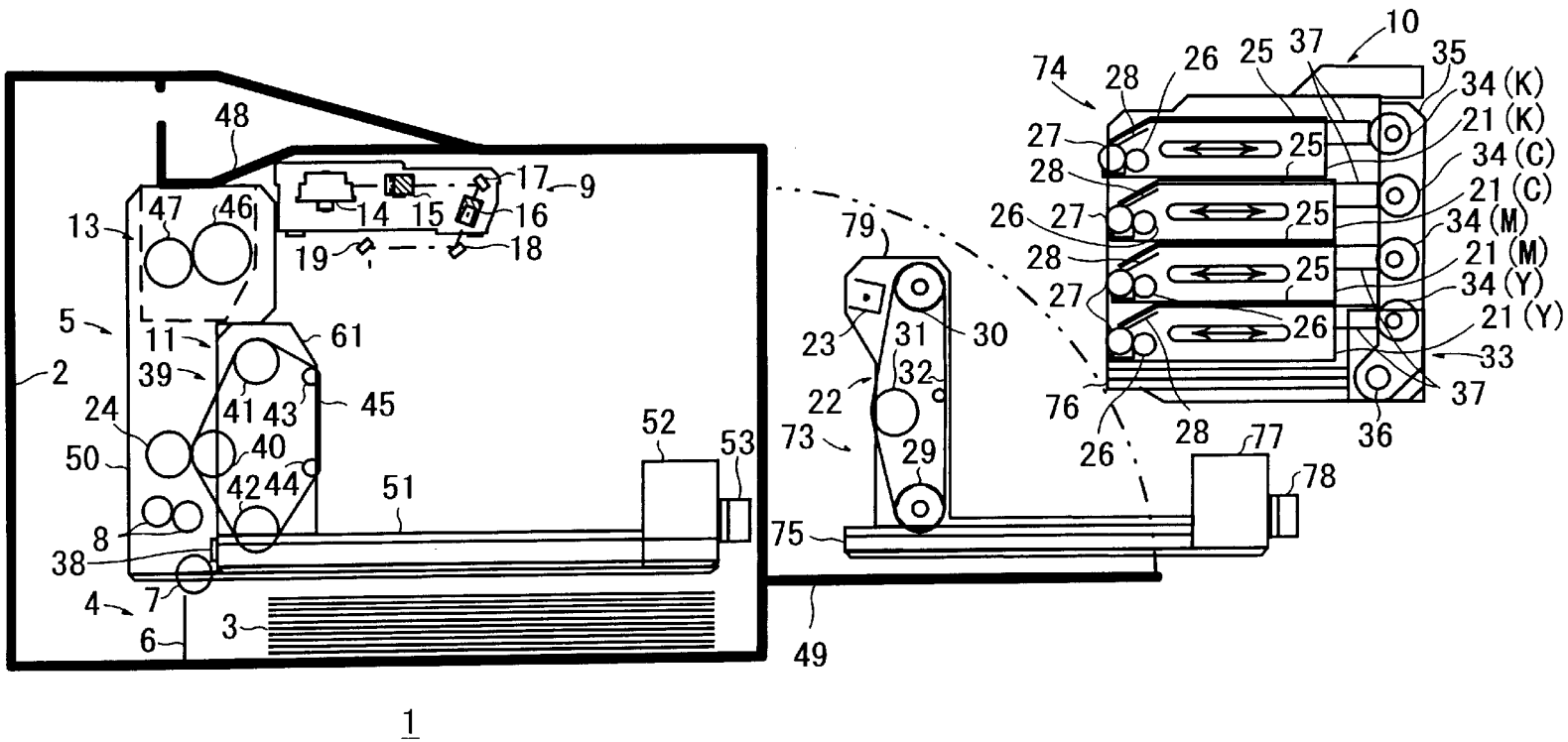
FIG. 9 is a diagram showing another processing unit which is attached to or detached from a color laser-beam printer.
Figure 10:
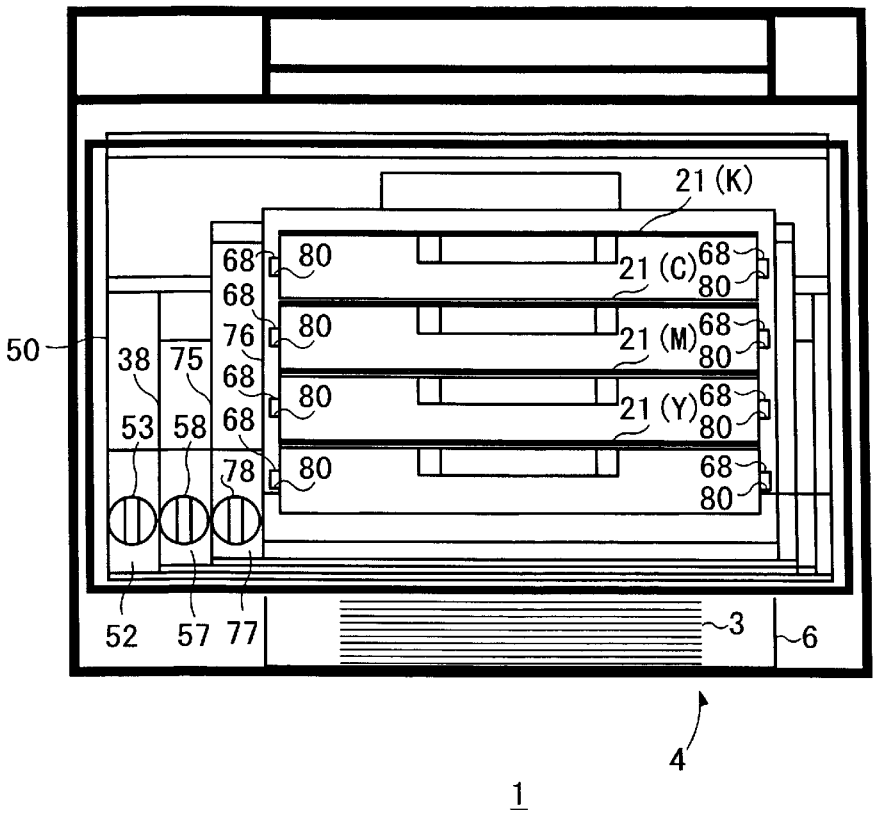
FIG. 10 is a rear view of the color laser-beam printer of FIG. 9.

Referring to FIGS. 9 and 10, another embodiment of the invention will be described below. Similar reference numerals have been used in this embodiment to denote similar parts.

In this embodiment, a processing unit 10 includes a photosensitive medium unit 73 and a developing device unit 74. The photosensitive medium unit 73 includes the photosensitive belt mechanism 22, which is integrally mounted on a photosensitive belt storage portion 75, and the scorotron charging device 23. The developing device unit 74 includes the cartridges 21Y, 21M, 21C, 21K, which is detachably mounted on a developing cartridge storage portion 76.

As shown in FIG. 10, the photosensitive belt storage portion 75 has a substantially C-shape, having side walls and a bottom wall and no upper wall, so as to accommodate the developing cartridge storage portion 76 therein. The side walls of the photosensitive belt storage portion 75 are provided with projections (not shown) that protrudes therefrom. The projections slidably engage the guide grooves 62 shown in FIG. 6. The projections are provided therein with rollers (not shown).

The side wall, facing the second locking mechanism 57, of the photosensitive belt storage portion 75 has two engagement grooves (not shown) that receive the engaging protrusions 59 of the second locking mechanism 57. In a state where the photosensitive belt storage portion 75 is accommodated in the intermediate transfer unit storage portion 38, the engagement grooves are opposite to the engaging protrusions 59 of the second locking mechanism 57.

A third locking mechanism 77 is provided at one side of the rear of the photosensitive belt storage portion 75 to lock the developing cartridge storage portion 76 with respect to the photosensitive belt storage portion 75.

The third locking mechanism 77 has a similar structure to the first and second locking mechanisms 52, 57 as described above. As shown in FIG. 10, the third locking mechanism 77 includes a rotatable pinching portion 78 and two engaging protrusions (not shown). The engaging protrusions retract in the inward direction of the casing 2 in synchronization with rotation of the pinching portion 78.

The pinching portion 78 can be moved between a first position when the developing cartridge storage portion 76 is locked and a second position when the developing cartridge storage portion 76 is unlocked.

As shown in FIG. 10, in the state where the photosensitive belt storage portion 75 is accommodated in the intermediate transfer unit storage portion 38, the third locking mechanism 77 are located in parallel with the first and second locking mechanisms 52, 57.

A guide groove (not shown), extending substantially in the horizontal direction, is provided to the side walls of the developing cartridge storage portion 76. The guide grooves guide the developing cartridge storage portion 76 when the developing cartridge storage portion 76 is attached to and detached from the photosensitive belt storage portion 75.

As shown in FIG. 9, a photosensitive belt fixing portion 79 is provided at the front end of the photosensitive belt storage portion 75 to fix the photosensitive belt mechanism 22. The photosensitive belt mechanism 22 is fixed to the photosensitive belt storage portion 75 by the photosensitive belt fixing portion 79.

As shown in FIG. 10, the developing cartridge accommodating portion 76 has a rectangular prism shape so as to accommodate the developing cartridges 21Y, 21M, 21C, 21K. The developing cartridge accommodating portion 76 has side walls that is provided with a projection (not shown), extending from one side to another side in the horizontal direction. The projections slidably engage the guide grooves of the photosensitive belt storage portion 75. Rollers (not shown) are rotatably provided in the projections.

The developing cartridge accommodating portion 76 has two engagement grooves (not shown) that receive the engaging protrusions of the third locking mechanism 77. In a state where the developing cartridge accommodating portion 76 is accommodated in the photosensitive belt storage portion 75, the engagement grooves are opposite to the engaging protrusions of the third locking mechanism 77.

When the third locking mechanism 77 locks the developing cartridge accommodating portion 76 in the photosensitive belt storage portion 75, the engaging protrusions protrude and engage the respective engagement grooves by rotation of the pinching portion 78 to the first position. Therefore, with respect to the photosensitive belt storage portion 75, the movement of the developing cartridge accommodating portion 76 is restricted and the developing device unit 74 and the photosensitive medium unit 73 are integrally fixed. That is, the developing device unit 74 and the photosensitive medium unit 73 can be detached and attached, with respect to the casing 2, and integrated with each other.

When the third locking mechanism 77 unlocks the developing cartridge storage portion 76, the engaging protrusions retract from the engagement grooves by rotation of the pinching portion 78 to the second position. Thus, the developing cartridge storage portion 76 becomes free from the restriction with respect to the photosensitive belt storage portion 75, and the developing device unit 74 can be separated from the photosensitive medium unit 73.

The both side walls of the developing cartridge storage portion 76 are provided with guide grooves 80 that guide the developing cartridges 21Y, 21M, 21C, 21K when the cartridges 21Y, 21M, 21C, 21K are detached therefrom and attached thereto and extend in substantially the horizontal direction, corresponding to the respective developing cartridges 21Y, 21M, 21C, 21K.

The projections 68 of the cartridges 21Y, 21M, 21C, 21K slidably engage the respective guide grooves 80 of the developing cartridge storage portion 76, so that the cartridges 21Y, 21M, 21C, 21K can be independently moved in the horizontal direction along the guide grooves 80 when detached and attached.

The developing cartridge traversing mechanism 33, having a similar structure to that described in the above-described embodiment, is provided to the rear end of the developing cartridge storage portion 76.

The projection of the photosensitive belt storage portion 75 slidably engage the guide grooves 62 of the intermediate transfer unit storage portion 38. Therefore, the photosensitive belt storage portion 75 can be detachably attached with respect to the intermediate transfer unit storage portion 38 in the horizontal direction.

The projections of the developing cartridge storage portion 76 slidably engage the guide grooves of the photosensitive belt storage portion 75. Therefore, the developing cartridge storage portion 76 can be detachably attached with respect to the photosensitive belt storage portion 75 in the horizontal direction.

When the photosensitive belt mechanism 22 is replaced, first, the cover 49 is opened, and then the third locking mechanism 77 unlocks the developing cartridge storage portion 76 while the first locking mechanism 52 locks the intermediate transfer unit storage portion 38 and the second locking mechanism 57 locks the photosensitive belt storage portion 75. By doing so, the intermediate transfer unit storage portion 38 and the photosensitive belt storage portion 75 are fixed with respect to the casing 2, and the developing cartridge storage portion 76 can be separated from the photosensitive belt storage portion 75 and pulled rearward in the horizontal direction.

Next, while the first locking mechanism 52 locks the intermediate transfer unit storage portion 38, the second locking mechanism 57 unlocks the photosensitive belt storage portion 75. By doing so, the intermediate transfer unit storage portion 38 is fixed with respect to the casing 2, and the photosensitive belt storage portion 75 can be separated from the intermediate transfer unit storage portion 38 and pulled rearward in the horizontal direction.

When the first locking mechanism 52 unlocks the intermediate transfer unit storage portion 38 while the second locking mechanism 57 locks the photosensitive belt storage portion 75 and the third locking mechanism 77 locks the developing cartridge storage portion 76, the intermediate transfer unit storage portion 38 can be pulled out with the photosensitive belt storage portion 75 and the developing cartridge storage portion 76 being integrated. Then, as the third locking mechanism 77 unlocks the developing cartridge storage portion 76, the photosensitive belt storage portion 75 and the developing cartridge storage portion 76 can be separated from each other.

As shown in FIG. 9, the color laser-beam printer 1 is separated into three parts, that is, the intermediate transfer unit storage portion 38 attached to the casing 2 via the accommodating portion 50, the photosensitive belt storage portion 75 removed from the casing 2, and the developing cartridge storage portion 76 removed from the photosensitive belt storage portion 75.

The photosensitive belt mechanism 22 is integrally fixed to the photosensitive belt storage portion 75. Accordingly, the photosensitive belt storage portion 75 is scrapped with the photosensitive belt mechanism 22, and a photosensitive belt storage portion 75 having a new photosensitive belt mechanism 22 is attached to the color laser-beam printer 1.

When the photosensitive belt storage portion 75 is attached, the projections of the photosensitive belt storage portion 75 engage the guide grooves 62 of the intermediate transfer unit storage portion 38 and then photosensitive belt storage portion 75 is pushed forward in the horizontal direction. Next, the projections of the developing cartridge storage portion 76 engage the guide grooves 62 of the photosensitive belt storage portion 75 and then developing cartridge storage portion 76 is pushed forward in the horizontal direction. After that, the second locking mechanism 57 locks the photosensitive belt storage portion 75 and the third locking mechanism 77 locks the developing cartridge storage portion 76.

As described above, the photosensitive belt mechanism 22 can be easily replaced with a new one. Further, the photosensitive belt mechanism 22 is integrated with the photosensitive belt storage portion 75 by the photosensitive belt fixing portion 79, so that the photosensitive belt mechanism 22 can be replaced with a new one only by scrapping the photosensitive belt storage portion 75 with the photosensitive belt mechanism 22. Accordingly, it is easy to replace the photosensitive belt mechanism 22.

The developing cartridge storage portion 76 and the photosensitive belt storage portion 75 can be attached and detached with respect to the casing 2 in the common direction, that is, back and forth in the horizontal direction. By performing the locking and unlocking using the second and third locking mechanisms 57, 77 as necessary, the developing cartridge storage portion 76 can be attached and detached with respect to the accommodating portion 50 and integrated with or separated from the photosensitive belt storage portion 75.

By separating the developing cartridge storage portion 76 from the photosensitive belt storage portion 75, the replacement and/or maintenance of all of the developing cartridges 21Y, 21M, 21C, 21K or can be implemented at the same time.

When the second locking mechanism 57 unlocks the photosensitive belt storage portion 75 and the third locking mechanism 77 locks the developing cartridge storage portion 76, the developing cartridge storage portion 76 and the photosensitive belt storage portion 75 can be integrally attached and detached with respect to the intermediate transfer unit storage portion 38 and the accommodating portion 50. When the first locking mechanism 52 locks the intermediate transfer unit storage portion 38 and the second locking mechanism 57 locks the photosensitive belt storage portion 75 and the third locking mechanism 77 unlocks the developing cartridge storage portion 76, only the developing cartridge storage portion 76 can be attached and detached with respect to the photosensitive belt storage portion 75, the intermediate transfer unit storage portion 38 and the accommodating portion 50.

As described above, it can be easily determined whether the developing cartridge storage portion 76 is to be integrated with or separated from the photosensitive belt storage portion 75, by selecting the locking or unlocking of the storage portions 38, 75, 76.

The pulling direction of the developing cartridge storage portion 76 is the same as that of the photosensitive belt storage portion 75, so that the developing cartridge storage portion 76 and the photosensitive belt storage portion 75 can be further easily and speedily attached and detached. The replacement and the maintenance of the cartridges 21Y, 21M, 21C, 21K and the photosensitive belt mechanism 22 can be easily and speedily implemented.

The developing cartridge storage portion 76 and the photosensitive belt storage portion 75 are pulled rearward in the horizontal direction, which is the same as the pulling direction of the intermediate transfer unit storage portion 38 and the sheet cassette 6. Accordingly, the operability of the color laser-beam printer 1 can be improved.

In the embodiment shown in FIGS. 9 and 10, the photosensitive belt mechanism 22 is integrated with the photosensitive belt storage portion 75, so that the photosensitive medium unit 73 is entirely replaced with a new one. However, the photosensitive belt mechanism 22 may be designed so that the photosensitive belt mechanism 22 can be attached and detached with respect to the photosensitive belt storage portion 75.

When the whole photosensitive medium unit 73 is replaced, the scorotron charging device 23 fixed to the photosensitive belt storage portion 75 is also scrapped. Generally, the life of the scorotron charging device 23 is longer than that of the photosensitive belt mechanism 22. Accordingly, there is a cost advantage if the photosensitive belt mechanism 22 is designed to be able to be attached and detached with respect to the photosensitive belt storage portion 75.

While the invention has been described in detail and with reference to the specific embodiments thereof, it would be apparent to those skilled in the art that various changes, arrangements and modifications may be applied therein without departing from the spirit and scope of the invention.

What is claimed is:

1. An image forming apparatus, comprising:

a casing;

a processing unit that includes a developing device and a photosensitive medium; and an intermediate transfer unit that includes an intermediate transfer medium, wherein the processing unit is attached to and detached from the intermediate transfer unit in a common direction when only the processing unit is removed from the casing and the intermediate transfer unit is attached to and detached from the casing in the common direction when the processing unit integrated with the intermediate transfer unit is removed from the casing.

2. The image forming apparatus according to claim 1, further comprising:

a first locking mechanism that locks the intermediate transfer unit with respect to the casing, wherein the intermediate transfer unit is fixed with respect to the casing when the first locking mechanism locks the intermediate transfer unit to the casing, and the intermediate transfer unit can be attached and detached with respect to the casing when the first locking mechanism unlocks the intermediate transfer unit.

3. The image forming apparatus according to claim 2, wherein the first locking mechanism includes an engaging protrusion that protrudes when the first locking mechanism locks the intermediate transfer unit and retracts when the first locking mechanism unlocks the intermediate transfer unit, and an engagement groove that faces and receives the engaging protrusion when the intermediate transfer unit is attached to the casing.

4. The image forming apparatus according to claim 3, further comprising:

a second locking mechanism that locks the processing unit with respect to the intermediate transfer unit, wherein the processing unit is fixed with respect to the intermediate transfer unit when the second locking mechanism locks the processing unit to the intermediate transfer unit, and the processing unit can be attached and detached with respect to the intermediate transfer unit when the second locking mechanism unlocks the processing unit.

5. The image forming apparatus according to claim 4, wherein the second locking mechanism includes an engaging protrusion that protrudes when the second locking mechanism locks the processing unit and retracts when the second locking mechanism unlocks the processing unit, and an engagement groove that faces and receives the engaging protrusion when the processing unit is attached to the intermediate transfer unit.

6. The image forming apparatus according to claim 1, wherein each of the intermediate transfer unit and the casing has a first electric connecting terminal, and the first electric connecting terminals of the intermediate transfer unit and the casing are opposite to and connected with each other when the intermediate transfer unit is attached to the casing.

7. The image forming apparatus according to claim 6, wherein each of the processing unit and the intermediate transfer unit includes a second electric connecting terminal, and the second electric connecting terminals of the processing unit and the intermediate transfer unit are opposite to and connected with each other when the processing unit is attached to the casing in a state where the intermediate transfer unit is attached to the casing.

8. The image forming apparatus according to claim 1, wherein the processing unit includes a plurality of the developing devices that detachably attach thereto, and each of the developing devices contains a developing material of a different color.

9. The image forming apparatus according to claim 8, wherein the photosensitive medium that is detachably attached from the processing unit.

10. The image forming apparatus according to claim 9, wherein the processing unit includes a processing unit storage portion to which the plurality of the developing devices and the photosensitive medium are attached, the intermediate transfer unit includes an intermediate transfer unit storage portion to which the intermediate transfer medium is stored, and the processing unit storage portion and the intermediate transfer unit storage portion can be attached and detached with respect to the casing in the common direction.

11. The image forming apparatus according to claim 10, further comprising:

a feed unit that feeds a recording medium and can be attached and detached with respect to the casing, wherein the feed unit is attached and detached with respect to the casing in a same direction as that of the processing unit storage portion and the intermediate transfer unit storage portion.

12. The image forming apparatus according to claim 1, wherein the developing device freely traverses with respect to the photosensitive medium, the attaching/detaching direction of the processing unit and the intermediate transfer unit with respect to the casing is the same as the developing device traversing direction.

13. The image forming apparatus according to claim 1, wherein the processing unit includes a developing device unit, to which a plurality of developing devices are detachably attached, and a photosensitive medium unit, to which the photosensitive medium is attached, the developing device unit and the photosensitive medium unit can be attached and detached with respect the casing in the common direction, and the developing device unit can be attached and detached with respect to the casing, with integrated with or separated from the photosensitive medium unit.

14. The image forming apparatus according to claim 13, further comprising:

a third locking mechanism that locks the developing device unit with respect to the photosensitive medium unit, wherein the developing device unit is fixed with respect to the photosensitive medium unit when the third locking mechanism locks the developing device unit, and the developing device unit can be attached and detached with respect to the photosensitive medium unit, with separated from the photosensitive medium unit when the third locking mechanism unlocks the developing device unit.

15. The image forming apparatus according to claim 14, wherein the third locking mechanism includes an engaging protrusion that protrudes when the third locking mechanism locks the developing device unit and retracts when the third locking mechanism unlocks the developing device unit, and an engagement groove that faces and receives the engaging protrusion when the developing device unit is attached to the photosensitive medium unit.

16. The image forming apparatus according to claim 13, wherein the photosensitive medium is integrally provided with the photosensitive medium unit.

17. The image forming apparatus according to claim 13, wherein the developing device unit includes a developing unit storage portion, to which the plurality of the developing devices are attached, the photosensitive medium unit includes a photosensitive medium storage portion, to which the photosensitive medium is attached, the intermediate transfer unit includes an intermediate transfer unit storage portion, to which the intermediate transfer medium is attached, and the developing device storage portion, the photosensitive medium storage portion and the intermediate transfer unit storage portion can be attached and detached in the common direction with respect to the casing.

18. The image forming apparatus according to claim 17, further comprising:

a feed unit that feeds a recording medium and can be attached and detached with respect to the casing, wherein the feed unit is attached and detached with respect to the casing in a direction same as that of the developing device storage portion, the photosensitive medium storage portion and the intermediate transfer unit storage portion.

19. The image forming apparatus according to claim 13, wherein the developing devices freely traverse with respect to the photosensitive medium, the attaching/detaching direction of developing device storage portion, the photosensitive medium storage portion and the intermediate transfer unit storage portion with respect to the casing is the same as the developing device traversing direction.

20. The image forming apparatus according to claim 1, wherein the processing unit is attached to and detached from the intermediate transfer unit before or when both the processing unit and intermediate transfer unit are removed from the casing.

21. The image forming apparatus according to claim 1, wherein the processing unit is attached to and detached from the intermediate transfer unit after both the processing unit and intermediate transfer unit are removed from the casing.

22. A method of removing, from a casing, a processing unit, that includes a developing device and a photosensitive medium, and an intermediate transfer unit, that includes an intermediate transfer medium, attached to the processing unit, comprising:

separating the processing unit from the intermediate transfer unit when only the processing unit is removed from the casing; and separating the intermediate transfer unit from the casing when both the processing unit and the intermediate transfer unit are removed from the casing.

23. The method of claim 22, wherein the developing device comprises a plurality of developing cartridges, comprising:

separating the cartridges from the developing device when only the cartridges are removed.

24. The method of claim 22, wherein after the processing unit is separated from the intermediate transfer unit and removed from the casing, the photosensitive medium is separated from the processing unit.

25. The method of claim 22, wherein the processing unit is separated from the intermediate transfer unit before or when both the processing unit and intermediate transfer unit are removed from the casing.

26. The method of claim 22, wherein the processing unit is separated from the intermediate transfer unit after both the processing unit and intermediate transfer unit are removed from the casing.

27. The method of claim 22, wherein the intermediate transfer medium is separated from the intermediate transfer unit after the intermediate transfer unit is removed from the casing.

28. The method of claim 22, wherein the developing device freely traverses with respect to the photosensitive medium, the attaching/detaching direction of the processing unit and the intermediate transfer unit with respect to the casing is the same as the developing device traversing direction.

29. The method of claim 22, wherein the processing unit includes a developing device unit, to which a plurality of developing devices are detachably attached, and a photosensitive medium unit to which the photosensitive medium is attached, comprising:

separating the developing device unit from the photosensitive medium unit when only the developing device unit is removed from the casing.

30. The method of claim 29, wherein the developing device unit is separated from the photosensitive medium unit after either the processing unit or both the processing unit and intermediate transfer unit are removed from the casing.

31. The method of claim 29, wherein the developing devices freely traverse with respect to the photosensitive medium, the attaching/detaching direction of developing device storage portion, the photosensitive medium storage portion and the intermediate transfer unit storage portion with respect to the casing is the same as the developing device traversing direction.

* * * * *